US005694894A

United States Patent [19]

Allen

[11] Patent Number: 5,694,894

[45] Date of Patent: Dec. 9, 1997

[54] VALVE CONTROL MEANS

[75] Inventor: Jeffrey Allen, Norfolk, United Kingdom

[73] Assignee: Lotus Cars Limited, Norfolk, United Kingdom

[21] Appl. No.: 811,143

[22] Filed: Mar. 3, 1997

Related U.S. Application Data

[63] Continuation of Ser. No. 495,540, filed as PCT/GB94/00619 Mar. 25, 1994 published as WO94/21899 Sep. 29, 1994, abandoned.

[30] Foreign Application Priority Data

Mar. 25, 1993 [GB] United Kingdom ..... 9306221

[51] Int. Cl.[6] ..... F01L 13/00; F01L 1/24; F02D 13/06

[52] U.S. Cl. ..... 123/90.16; 123/90.55; 123/198 F

[58] Field of Search ..... 123/90.15, 90.16, 123/90.17, 90.48, 90.49, 90.55, 90.39, 90.44, 198 F

[56] References Cited

U.S. PATENT DOCUMENTS

| | | | |
|---|---|---|---|
| 5,090,364 | 2/1992 | McCarroll et al. | 123/90.16 |
| 5,193,496 | 3/1993 | Keuger | 123/90.16 |
| 5,253,621 | 10/1993 | Dopson et al. | 123/90.16 |
| 5,287,830 | 2/1994 | Dopson et al. | 123/90.16 |
| 5,361,733 | 11/1994 | Spath et al. | 123/90.16 |

FOREIGN PATENT DOCUMENTS

| | | |
|---|---|---|
| 0 259 106 | 3/1988 | European Pat. Off. . |
| 2141025 | 1/1973 | France . |
| 1958627 | 6/1971 | Germany . |
| 3347680A1 | 8/1984 | Germany . |
| 3311280 | 10/1984 | Germany . |
| WO-A-91/12413 | 8/1991 | WIPO . |

*Primary Examiner*—Weilun Lo

*Attorney, Agent, or Firm*—Fulwider Patton Lee & Utecht, LLP

[57] ABSTRACT

The valve control means for use in an internal combustion engine has a valve member 180, a cam assembly comprising a rotatable camshaft (185) having a first portion (181) and a second portion (182) having a different cross section from the first portion (181). The valve control assembly comprises first follower member (100) engageable with the valve member (180) and engageable with the first portion (181), a hydraulic lash adjuster assembly provided in the first follower member (100). A second follower assembly (150) moveable relative to the first follower member (100) and engageable with the second portion (182) and a linking assembly (160, 163, 167) to enable the first (100) and second (150) followers to be linked together. In use of the valve control when the first (100) and second (150) follower are not linked the motion of the valve (180) is controlled by the first follower (100) and the valve (180) is given in each engine cycle the lift of the first portion (181) and when the first (100) and second (150) follower are linked the motion of the valve (180) is controlled by the second follower (150) and the valve (180) is given in each engine cycle the lift of the second portion (182).

10 Claims, 6 Drawing Sheets

VALVE CONTROL MEANS

This application is a continuation of application Ser. No. 08/495,540, filed as PCT/GB94/00619 Mar. 25, 1994, published as WO94/21899 Sep. 29, 1994, now abandoned.

BACKGROUND OF THE INVENTION

1. Field of the Invention

The present invention relates to valve control means for an internal combustion engine.

The valve control means of the present invention will be described by reference to use of the valve control means in the internal combustion engine of an automobile, but the invention should not be considered limited to such use.

2. Description of Related Art

In WO91/12413 there is described valve control means for controlling the inlet and exhaust valves of an internal combustion engine. In each of the illustrated embodiments of the specification there is shown a camshaft having a first cam and a second cam having a different cam profile from the first cam. Means are provided for relaying the camming action of the cams to an inlet or exhaust valve of the engine. The means for transmitting the reciprocating movement comprises a first cam follower member which engages an inlet or exhaust valve and a second cam follower member which is moveable relative to the first cam follower member and locking means which can link the two cam follower members to move together. When the first and second cam follower members are not linked the camming action of the first cam is transmitted by the first cam follower member to the controlled valve, the lift of the valve following the profile of the first cam. When the first and second cam follower members are linked together the camming action of the second cam is relayed to the controlled valve via both of the first and second cam follower members, the lift of the controlled valve being controlled by the profile of the second cam.

The locking means of the system described in WO91/12413 is operable under the control of hydraulic pressure. The locking means is controlled so that the lift of the controlled valve is controlled by the cam profile of one of the cams at low engine speeds and by the cam profile of the other cam at high engine speeds. This gives an advantage over the previously known engines, because the relationship between valve lift and crankshaft position can be varied at different engine speeds to optimize engine efficiency.

The valve control means described in WO91/12413 includes a hydraulic lash adjuster. Hydraulic lash adjusters are well known in the art and are used to compensate for wear of components in the valve drive trains. A hydraulic lash adjuster will expand to ensure that the components of the valve control means remain in contact with each other despite wear.

There are tight constraints on the packaging of valve control means in modern day engines. This is particularly the case in engines which use four valve per cylinder. For this reason, valve control means used should be kept as small as possible.

The first cam follower member of the valve control means of WO91/12413 is a bucket tappet slidable in a bore provided in the second cam follower member. Bucket tappets are well known in prior art engines. In the system of WO91/12413 the hydraulic lash adjuster acts between the bucket tappet and the controlled valve, with the stem of the controlled valve directly abutting the hydraulic lash adjuster.

A more detailed description of the valve control means of WO91/12413 will be given later with reference to one of the drawings of this application.

Bucket tappets used in conventional engines are of a diameter typically in the range 19 mm to 40 mm. The tappets must be of such a size to give the required mechanical advantage for the cam profiles used in conventional engines. Mechanical advantage is gained by distancing the point of contact between the tappet and the lift portion of a cam from the central axis of the tappet. To achieve the acceleration of the valve required by a cam profile suitable for all speed or high speed engine operation of an engine a minimum distance must be allowed and thus a minimum area of tappet provided. There is thus a geometrical relationship between the lift velocity of a cam profile and the area of tappet used.

In certain push-rod engines, hydraulic lash adjusters are known in which one of the components which defines the expandable chamber for hydraulic fluid directly abuts a cam and the other component which defines the chamber is connected to a push rod. However, such a lash adjuster has never to the applicant's knowledge been used in an overhead camshaft engine and furthermore the lash adjusters used to date in the push-rod engines have typically had an external diameter of 19 mm or above since they are required to have a minimum area by the cam profiles used in the push-rod engines.

SUMMARY OF THE INVENTION

The present invention provides valve control means for use in an internal combustion engine which has valve means, cam means: comprising a rotatable camshaft having a first portion and a second portion having a different cross-section from the first portion, the valve control means comprising:

first follower means engageable with the valve means and engageable with the first portion, hydraulic lash adjuster means provided in the first follower means and having a first member which defines a closed bore, a second member movable in the bore of the first member and defining with the first member a variable volume chamber for hydraulic fluid, conduit means for allowing flow of fluid to the chamber and valve means for controlling the flow of fluid to the chamber.

second follower means movable relative to the first follower means and engageable with the second portion, and linking means to enable the first and second follower means to be linked together, wherein, in use of the valve control means, when the first and second follower means are not linked the motion of the valve means is controlled by the first follower means and the valve means is given in each engine cycle the lift of the first portion, when the first and second follower means are linked the motion of the valve means is controlled by the second follower means and the valve means is given in each engine cycle the lift of the second portion, characterised in that:

a wear surface engageable with the first portion is provided on the exterior of the first member of the hydraulic lash. adjuster means.

The applicant has realized that since one of the follower members of the present invention is designed to be driven by a low lift cam (or no lift lobe as will be described later) designed for low speed operation, the area of the follower member engaging the cam can be reduced (minimum area being proportional to lift). Thus the bucket tappet of WO91/12413 is no longer needed and the valve control means can be reduced in size.

The valve control means of WO91/12413 could be used in certain existing engines which have bucket tappets and hydraulic lash adjusters, the valve control means being simply positioned in the bores provided in the engine for the bucket tappets and the hydraulic lash adjusters. However, since the valve control means of WO91/12413 could only be installed in a restricted range of such engines because of the overall size of the valve control means. Since the valve control means of the present invention can be made smaller than the valve control means of WO91/12413, the valve control means can be installed in a greater range of engines.

Preferably the second follower means defines a bore and the first follower means is slidably located in the bore, the cross-section of the bore matching in shape and size the cross-section of the portion of the first member of the hydraulic lash adjustment means slidable in the bore.

Preferably the first and second follower means are cylindrical and the first follower means has a diameter in the range of 8 to 18 mm. The bucket tappets of the prior art typically have diameters in the range 19 to 40 mm.

The first follower means is thus of a first diameter and the second follower means of a second large diameter. Both diameters must at least be of a certain minimum to allow for the lifts of the first and second cams (if two cams are used). However in operation, the first follower means will engage a cam of lower lift (or a lobe of no lift as will be described later) than the second follower means and thus the first diameter can be smaller than the second diameter.

Preferably engagement means is provided on the exterior surface of the first member of the hydraulic lash adjuster means, the engagement means enabling the linking means to link together the first and second follower means.

Thus the linking means engages the exterior surface of the hydraulic lash adjuster means, rather than a bucket tappet (as in the prior art).

The present invention also provides an internal combustion engine having valve control means as previously described wherein the wear surface of the first member of the hydraulic lash adjuster means directly abuts a portion of the camshaft.

In engines using the valve control means of WO91/12413, the hydraulic lash adjuster means abuts a bucket tappet which then abuts a portion of a camshaft. This followed the accepted practice of providing bucket tappets with hydraulic lash adjusters located within. The present invention breaks away from accepted practice.

If the internal combustion engine is an overhead camshaft engine which has a poppet valve moveable to open and close a port in a cylinder of the engine then the poppet valve preferably directly abuts the second member of the hydraulic lash adjuster means.

The present invention also has the advantage that the valve drivetrain can be made lighter since a bucket tappet is not included in the valve drivetrain.

If the internal combustion engine is a push-rod engine then the push-rod is preferably connected to the second member of the hydraulic lash adjuster means.

In a second aspect the invention provides valve control means for use in an internal combustion engine which has valve means, cam means comprising a rotatable camshaft having a first portion and a second portion having a different cross-section from the first portion, the valve control means comprising:

first follower means engageable, with the valve means and engageable with the first portion, hydraulic lash adjuster means provided in the first follower means and having a first member which defines a closed bore, a second member movable in the bore of the first member and defining with the first member a variable volume chamber for hydraulic fluid, conduit means for allowing flow of fluid to the chamber and valve means for controlling the flow of fluid to the chamber, second follower means movable relative to the first follower means and engageable with the second portion, and linking means to enable the first and second follower means to be linked together, wherein, in use of the valve control means, when the first and second follower means are not linked the motion of the valve means is controlled by the first follower means and the valve means is given the lift of the first portion, when the first and second follower means are linked the motion of the valve means is controlled by the second follower means and the valve means is given the lift of the second portion, and wherein the second follower means defines a bore and the first follower means is located in the bore with at least a portion of the first member of the hydraulic lash adjuster means being slidable in the bore, characterized in that, the cross-section of the bore matches in shape and size the cross-section of the portion of the first member of the hydraulic lash adjuster means slidable in the bore.

Preferably the bore is of circular cross-section and the first member of the hydraulic lash adjuster means is of a circular exterior cross-section, the diameter of the bore being corresponding to the exterior diameter of the first member of the hydraulic lash adjuster means.

In a third aspect the invention provides valve control means for use in an internal combustion engine which has valve means, cam means comprising a rotatable camshaft having a first portion and a second cam having a different cross-section from the first portion, the valve control means comprising:

first follower means engageable with the valve means and engageable with the first portion, hydraulic lash adjuster means provided in the first follower means and having first member which defines a closed bore, a second member movable in the bore of the first member and defining with the first member a variable volume chamber for hydraulic fluid, conduit means for allowing flow of fluid to the chamber and valve means for controlling the flow of fluid to the chamber.

second follower means movable relative to the first cam follower means and engageable with the second portion, and linking means to enable the first and second follower means to be linked together, wherein, in use of the valve control means, when the first and second follower means are not linked the motion of the valve means is controlled by the first cam follower means and the valve means is given in each engine cycle the lift of the first portion, when the first and second follower means are linked the motion of the valve means is controlled by the second follower means and the valve means is given in each engine cycle the lift of the second portion, characterized in that:

engagement means is provided on the exterior surface of the first or second member of the hydraulic lash adjuster means, the engagement means enabling the linking means to link together the first and second follower means.

Preferably the engagement means is provided on the exterior surface of the first member of the hydraulic lash adjustment means.

Preferably the engagement means comprises a recess in the exterior surface of the first member of the hydraulic lash adjuster means and the linking means comprises a locking pin in the second follower means and extendable from the second follower means to engage the recess.

The present invention is therefore advantageous over valve control means such as the valve control means described in WO91/12413, because the hydraulic lash adjuster means can directly abut a portion of a camshaft (without the interposition of a bucket tappet) and therefore the valve control means can be of an overall diameter which is appreciably smaller than the diameter of the valve control means of the prior art.

Preferably the first portion of the camshaft is a first cam having a first cam profile, the second portion of the camshaft is a second cam having a second cam profile different to the first cam profile, the first follower means comprises first cam follower means engageable with the first cam and the second follower means comprises second cam follower means engageable with the second cam.

Alternatively the first portion of the camshaft can be a portion of circular cross-section which imparts no lift to valve means, the second portion of the camshaft is a cam and the second follower means comprises second cam follower means engageable with the cam.

The present invention in a fourth aspect provides an overhead camshaft engine having a rotatable camshaft, valve means and a hydraulic lash adjuster acting between the valve means and a portion of the camshaft, the hydraulic lash adjuster comprising:

a first member which defines a closed bore, a second member movable in the closed bore and defining with the first member a variable volume chamber, conduit means for allowing flow of fluid to the chamber, and valve means for controlling the flow of fluid to and from the chamber, characterized in that the cam directly engages a wear surface provided on the first member of the hydraulic lash adjuster.

In creating the design of novel valve control means the applicant has also designed a novel form of hydraulic lash adjuster for an overhead camshaft engine.

In the overhead camshaft engine the first member preferably comprises a cavity and the conduit means comprises a first passage connecting the cavity with the exterior of the first member and a second passage connecting the cavity with the variable volume chamber, the valve means being operable to control flow of fluid from the cavity to the variable volume chamber.

For effective operation of a hydraulic lash adjuster the variable volume chamber should be lowermost so that gravity acts to encourage flow of fluid into the chamber. The design allows for this, whilst also allowing the lash adjuster component of greater cross-sectional area to be uppermost to engage a cam.

Preferably a third passage is provided to connect the cavity with the wear surface provided on the first member, whereby the wear surface can be lubricated by fluid from the cavity.

The third passage provides lubrication and prevents air locks in the hydraulic lash adjuster.

BRIEF DESCRIPTION OF THE DRAWINGS

Preferred embodiments of the present invention will now be discussed with reference to the accompanying drawings in which.

DETAILED DESCRIPTION OF THE PREFERRED EMBODIMENTS

Figure 1:
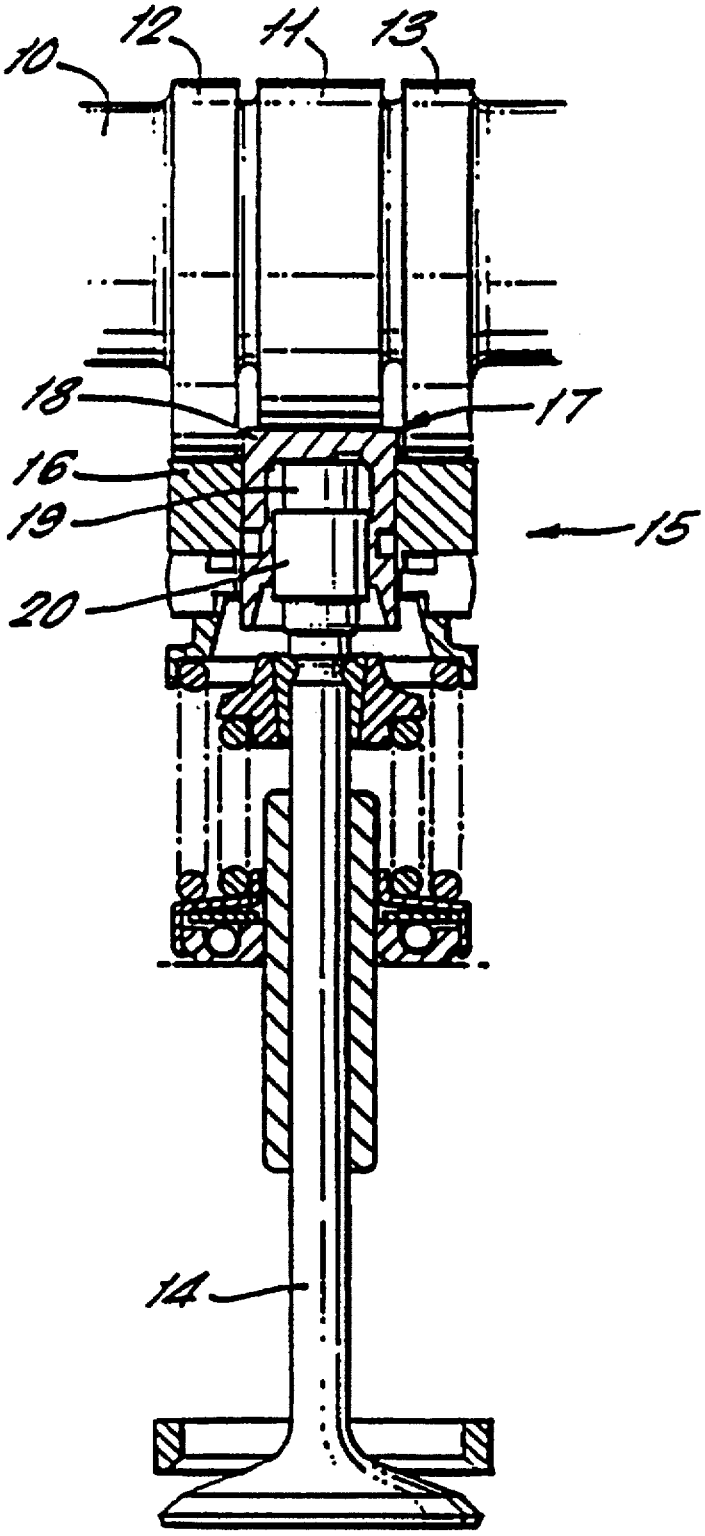
FIG. 1 PRIOR ART
FIG. 1 shows prior art valve control means.

Turning first to describe the prior art valve control means, as shown in WO91/12413, there can be seen in FIG. 1 a camshaft 10 having a first cam 11 of a first cam profile and two further cam members 12 and 13 each having the same cam profile, the cam profile being different to the cam profile of the cam 11.

The FIG. 1 illustrates the valve control means of the prior art in a first operating condition, in which an inlet valve 14 is controlled by the profile of the cam 11.

Valve control means 15 of the prior art system can be seen in FIG. 1 to comprise an outer cam follower member 16 which takes the form of a cylinder and an inner cam follower member 17 which is slidable within a bore of the outer cam follower member 16.

In the prior art embodiment the inner cam follower member 17 comprises a bucket tappet 18, well known in the prior art. A hydraulic lash adjuster comprising members 19 and 20 is located within the bucket tappet 18.

The member 20 abuts the top of the inlet valve 14 and has a portion of an external diameter which corresponds to the internal diameter of the bucket tappet 18. The member 19 abuts the bucket tappet 18 and is slidable within the member 20. In a known manner, the members 19 and 20 define between them a chamber and a check valve is provided to control flow of fluid into the chamber. Fluid can be admitted into the chamber, but the check valve prevents fluid from flowing from the chamber. The members 20 and 19 move relative to teach other to expand the chamber defined between them to compensate for wear in the components of the valve control mechanism, eg. wear of the cam members 11, 12 and 13.

It should be appreciated that the inner cam member thus comprises a bucket tappet 18 and a hydraulic lash adjuster located to act between the bucket tappet 18 and the valve 14.

Figure 2:
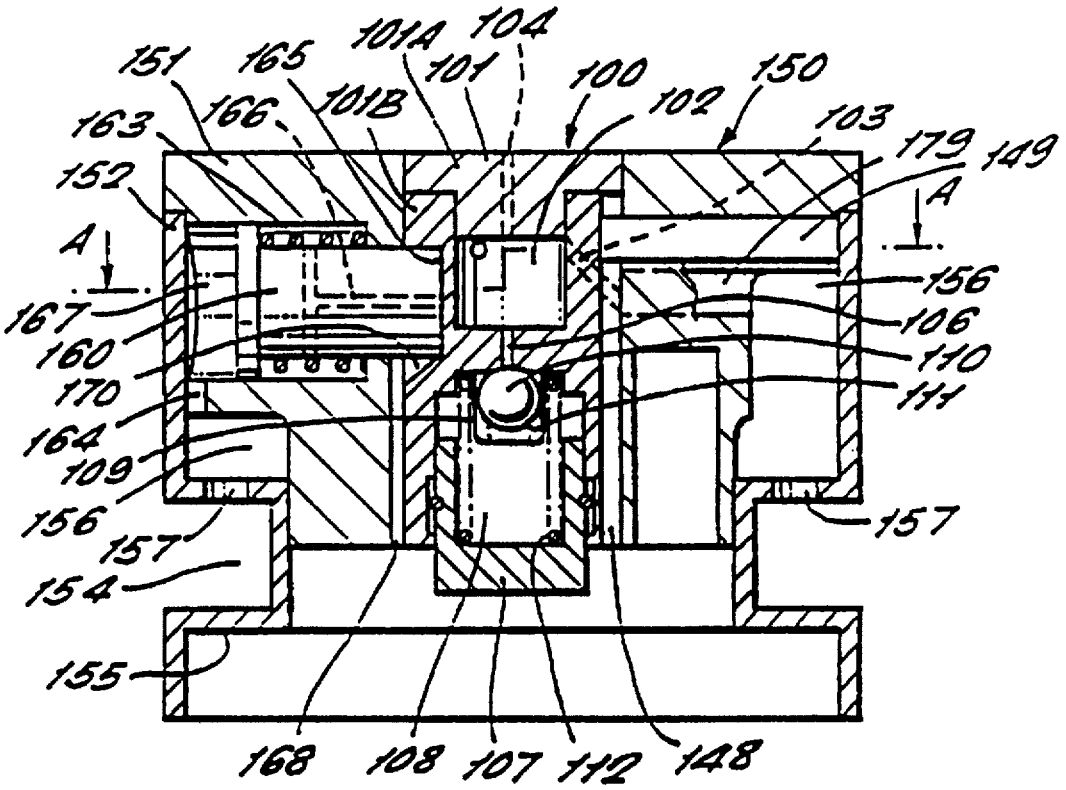
FIG. 2 shows a cross-section of a first embodiment of valve control means according to the invention, the cross-section being taken along the line BB of FIG. 3, in the direction of the arrows shown.

Referring now to FIG. 2 there can be seen valve control means according to the present invention. The valve control means according to the present invention comprise a first cam follower member 100 which is movable in a bore provided in a second cam follower member 150.

The first cam follower member 100 provides hydraulic lash adjustment. The first cam follower member 100 comprises an upper member 101 which provides a wear surface for engaging a cam. The upper member 101 in FIG. 2 is formed of two parts 101A and 101B which are attached to each other. Part 101A will typically be made of alloy cast iron and part 101B will typically be made of steel.

The upper member 101 is generally cylindrical in form. There is an upper cavity 102 provided in the member 101 which communicates with the exterior of the member 101 via a passage 103. The cavity 102 is cylindrical and at the lower end of the cavity 102 there is provided a passage 106 leading downwardly from the cavity 102.

The member 101 also has a lower cavity which is of greater diameter than the upper cavity 102. In the lower cavity a lower member 107 of the first cam follower member 100 is slidable relative to the member 101.

The lower member 107 and the upper member 101 define between them a chamber 108. The chamber 108 can communicate with the chamber 102 via the passage 106. Check valve means are provided to control the flow of fluid through the passage 106. The check valve means comprise a valve retainer 109, a ball 110, a light spring 111 acting between the ball 110 and the valve retainer 109 and a spring 112 acting between the upper member 101 and the lower member 107.

The lower member 107 of the first cam follower means 100 has an external diameter which corresponds to the diameter of the lower cavity of the upper member 101.

The second cam follower means 150 comprises a first member 151 which provides a surface which is engageable by a cam. The member 151 is generally cylindrical in nature and will typically be made of cast iron alloy. Attached to the member 151 is a skirt 152 typically made of steel, again of a generally cylindrical nature. The outer diameter of the outer steel skirt 152 corresponds to the greatest diameter of the member 151.

The skirt 152 has a portion of reduced diameter which defines an annular recess 154. The portion of reduced diameter also defines an annular seat 155 engageable by a spring.

Between the member 151 and the skirt 152 there is defined an annular cavity 156. The annular cavity 156 communicates with the annular recess 154 via passages 157.

Figure 3:
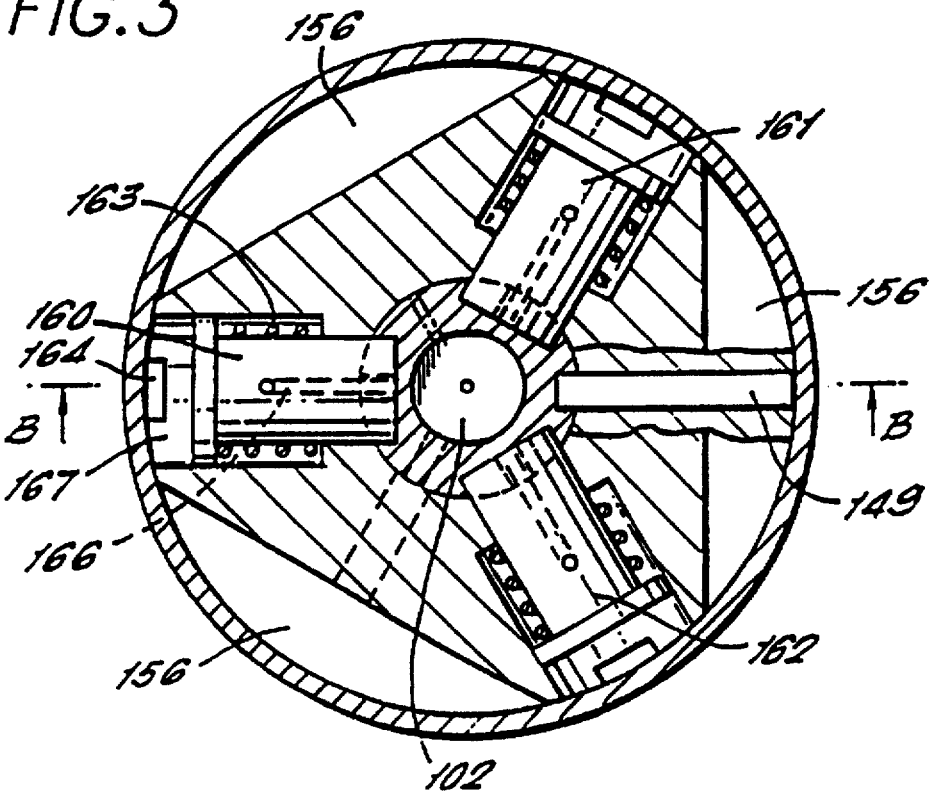
FIG. 3 shows a cross-section of the valve control means of the first embodiment shown in FIG. 2, the cross-section being taken along the line AA shown in FIG. 2, in the direction of the arrows shown.

Locking pins 160, 161 and 162 can be seen in FIG. 3. Locking pin 160 can also be seen in FIG. 2. The locking pins 160, 161 and 162 are identical to each other and are mounted in the member 151 in identical fashion. Therefore, we will only discuss in detail the locking pin 160.

The locking pin 160 is slidable in a radially extending bore in the member 151. A spring 163 is provided to act between an increased diameter portion of the locking pin 160 and the member 151, to bias the locking pin 160 radially outwardly. The locking pin 160 is biased by the spring 163 into abutment with the steel skirt 152. Since the rear portion of the locking pin 160 is flat whilst the inner surface of the skirt 152 is cylindrical, a cavity 167 is maintained between the locking pin 160 and the skirt 152 even when the locking pin 160 abuts the skirt 152. A passage 164 is provided in the member 151 to allow communication between the cavity 167 and the cavity 156.

The locking pin 160 is designed to slide radially in the bore in the member 151 to engage a recess 165 defined in the exterior surface of the member 101 of the first cam follower means.

A bore 166 is provided through the locking pin 160 to allow communication between the recess 165 and the cavity defined between the locking pin 160 and the member 151. A groove 168 is provided on the surface of the member 101 to allow communication of the recess 165 via a passage 170 with the bottom surface of the member 101.

A pin 149 is provided to extend inwardly from the cam follower means 150 to engage a groove 148 which extends axially down the cam follower means 100. The pin 149 prevents relative rotation between the cam follower means 100 and 150.

Figure 4:
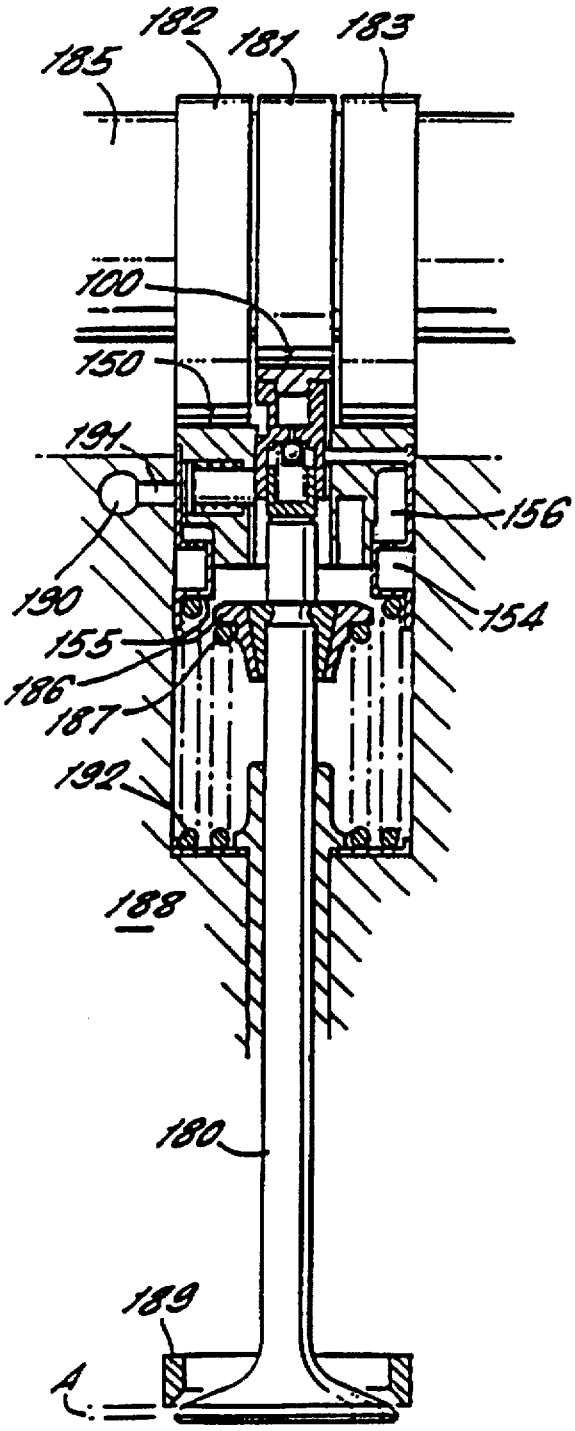
FIG. 4 shows a cross-sectional view of the valve control means of the first embodiment in use in an internal combustion engine in a first operating condition.
Figure 5:
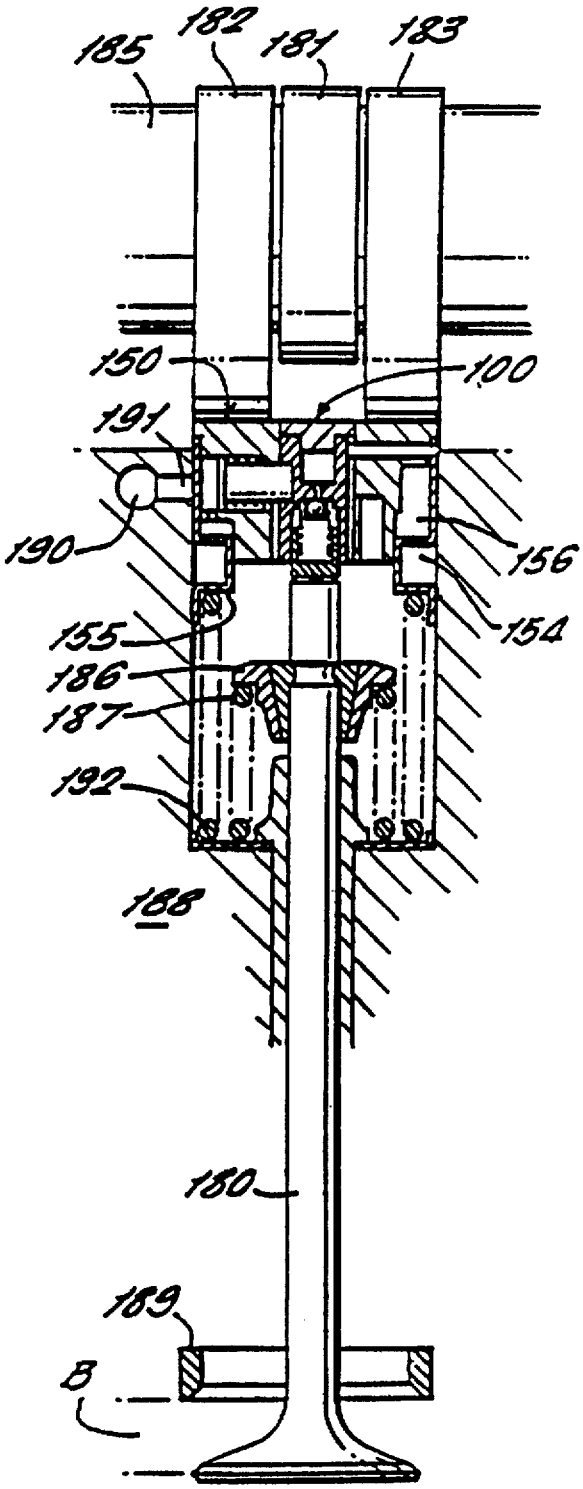
FIG. 5 shows a cross-section of valve control means according to the first embodiment of the invention in use in an internal combustion engine in a second operating condition.
Figure 4A:
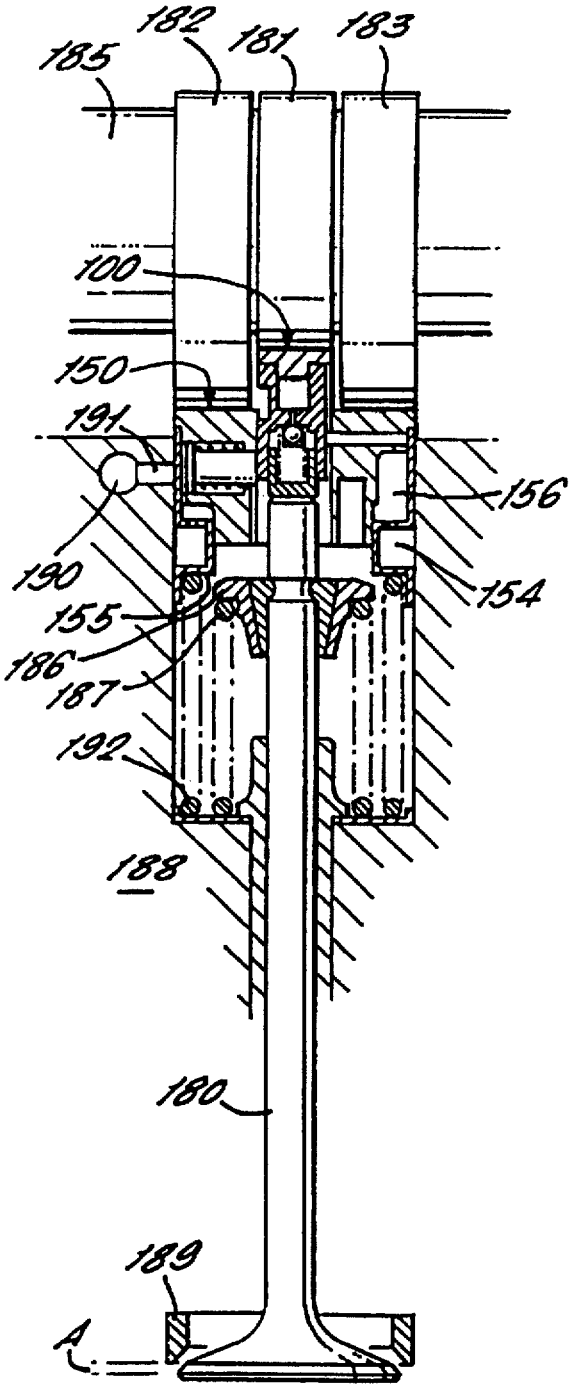
FIG. 4A shows a cross-sectional view of a modified version of the valve control means of FIG. 4 in the first operating condition, the valve control means modified to provide valve deactivation.
Figure 5A:
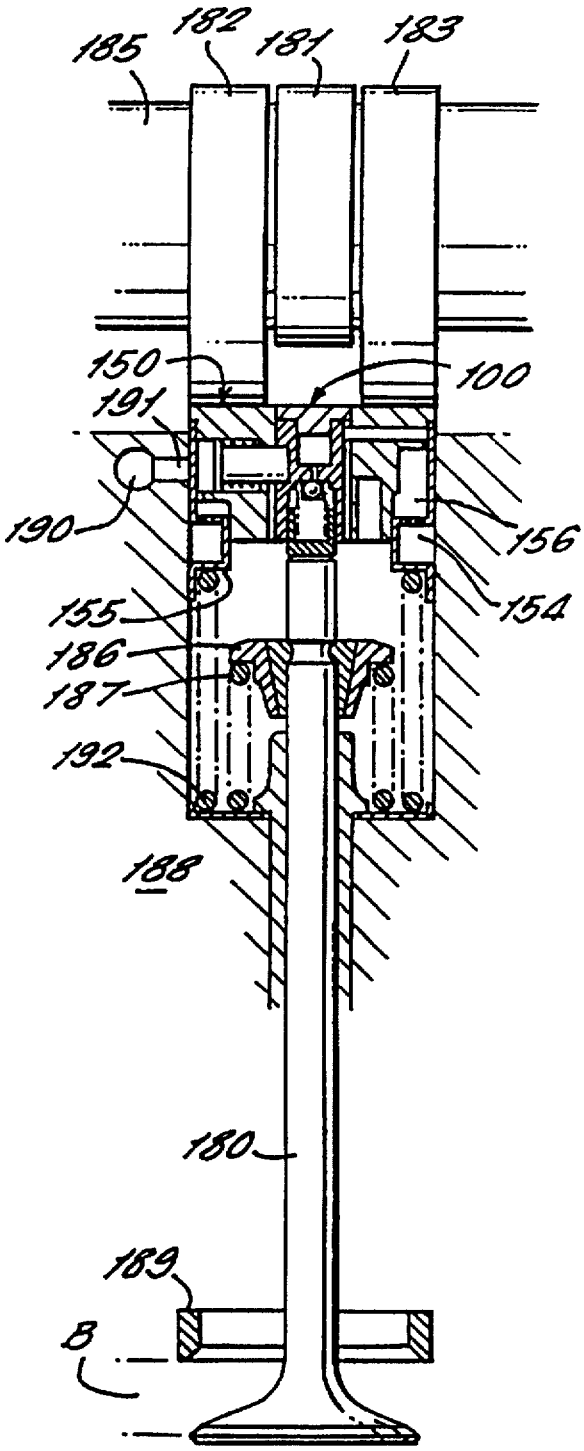
FIG. 5A shows a cross-sectional view of the modified valve control means of FIG. 4A in a second operating condition corresponding to the second operating condition illustrated in FIG. 5.

The first preferred embodiment of the valve control means can be seen in use in an internal combustion engine in FIGS. 4 and 5.

In FIG. 4, the low speed operation of the internal combustion engine is shown. In the figure there can be seen an inlet valve 180 of a cylinder of an internal combustion engine. There can also be seen three cams 181, 182 and 183 provided on a camshaft 185 for rotation therewith. The cam 181 has a first low lift cam profile and the cams 182 and 183 each have the same high lift cam profile.

The inlet valve 180 is a poppet valve provided with a spring retainer 186. A valve spring 187 acts between the spring retainer 186 and the cylinder head of the engine shown generally at 188. The spring 187 acts to bias the poppet valve 180 into its valve seat 189.

The valve control means of the invention is provided in a bore in the cylinder head 188, and is slidable in the bore. An oil gallery 190 is provided in the cylinder head 188, which communicates with the annular recess 154 of member 152 when the valve control means is located in the bore.

A spring 192 is provided to act between the spring seat 155 of the valve control means and the cylinder head 188 and the spring 192 biases the second cam follower member 150 into abutment with the two cams 182 and 183.

In the operating condition shown in the FIG. 4, the oil pressure in oil gallery 190 is kept at a low level. The fluid pressure is communicated from the oil gallery 190 via the recess 154 of the valve control means to the annular cavity 156 of the valve control means. The fluid pressure is then relayed by the passages 164 to the cavities 167 defined behind the locking pins (locking pin 160 being shown in the figure). The low oil pressure is insufficient to overcome the biasing effect of the spring 163 and therefore the locking pin 160 (and the other locking pins 161 and 162) remain retracted within the cam follower member 162 remain retracted within the cam follower member 150 and the cam follower member 150 is not linked in any way to the cam follower member 100.

Since the cam follower members 100 and 150 are not linked, they move independently of each other. The cam follower member 100 engages the surface of the cam 181 and will transmit the camming action of the cam 181 to the inlet valve 180. This imparts to the valve 180 a lift A shown in FIG. 4.

Control means will be provided in the internal combustion engines to control the pressure of the fluid in oil gallery 190. The control means will typically switch the oil pressure from a low pressure to a high pressure when a particular engine speed is reached. In FIG. 5, the pressure in the oil gallery 190 has been switched to a high pressure and the high pressure oil has been communicated to act on the locking pins 160, 161 and 162, which have engaged the inner cam follower member 100 and have linked the cam follower members 100 and 150, so that they move together. The inlet valve 180 is thus controlled by the profile of the cams 182 and 183, which is a higher lift profile than the profile of the cam 181. The increased lift of the valve is indicated at B in the FIG. 5. Since the cams 182 and 183 have a higher lift than cam 181, the inner cam follower member 100 will not engage the cam 181 whilst the cam follower member 150 engages the high lift portions of the cams 182 and 183. This can be seen in FIG. 5.

When the engine speed returns below the chosen level, the pressure in the oil gallery 190 will be returned to a low level and the springs 163 will move the locking pins 160, 161 nd 162 out of engagement with the inner cam follower member 100, so that the cam follower members 100 and 150 are not linked and the valve 180 is again controlled by the profile of the cam 181.

Engagement of the locking pins with the inner cam follower member 100 can only occur when the cam follower means 100 and 150 are in alignment during the base circle portions of the cams 181, 182 and 183 and this is advantageous to ensure a smooth switch over. Furthermore, due to friction between the locking pins 160, 161, 162 and the cam follower member 100, the locking pins can only be retracted while the cam follower members engage the base circle portion of the cams 181, 182 and 183. This again is advantageous to ensure a smooth switch over.

When the locking pins 160, 161 and 162 are moved radially inwardly under fluid pressure, it is important to ensure that a hydraulic lock does not occur due to fluid trapped between the locking pins and the cam follower member 150. This is prevented in the first preferred embodiment of the invention described above by the provision of the passage 166 which allows fluid to flow out of the chamber defined between the locking pin 160 and the cam follower member 150 when the locking pin 160 us moving radially inwardly. The fluid flows from the chamber through the passage 166 into the recess 165 defined on the exterior of the inner cam follower member 101 and from the recess 165 down the groove 168.

The hydraulic lash adjustment means of the invention is supplied with oil in both operating conditions when the cam follower members 100 and 150 engage the base circle portions of the cams 182, 181 and 183. As components wear in the valve control means and as the cams and the valve 180 wears, the spring 112 acts to push the member 107 away from the member 101 and to draw oil into the bottom. chamber 108 from the top chamber 102 via the passage 106. It will be appreciated that the spring 112 is of greater resilience than the light spring 111 which merely serves to locate the ball 110 adjacent to the passage 106. The member 107 can only move away from the member 101, since the ball 110 will act to stop fluid flowing from the chamber 108 into the chamber 102 when a compressive force is applied on the two members 101 and 107.

The chamber 102 is supplied with hydraulic fluid via the passages 103 and passages 179 with the fluid being supplied from the cavity 156 which is in turn supplied through passage 157 and annular cavity 154 from the oil gallery 190.

The passage 104 serves to allow a fluid to flow from the chamber 102 to the top surface of the cam follower members 100 and 150, the hydraulic fluid then lubricating the cam follower surfaces and minimizing wear and preventing air being trapped in cavity 102.

The hydraulic lash adjustment means of the invention has advantageous features not present in the hydraulic lash adjustment means of the prior art since it does not require a bucket tappet and therefore allows the valve control means of the present invention to be smaller than the valve control means of the prior art. Instead one of the members which defines the variable volume chamber of the hydraulic lash adjuster has a wear surface which is engageable directly with a cam (or with a rocker arm positioned between the cam and the follower member, as seen in one embodiment of WO91/12413). The member has a recess defined on its exterior surface which can be engaged by locking pins. Thus the diameter of the bore of the external cam follower means 151 can be reduced in comparison to the bores of the prior art valve control means since the bore does not have to accommodate a bucket tappet. Instead the cross-sectional area of the bore can be as small as the cross-sectional area of the largest part of the largest of two members which define the expandable chamber of the hydraulic lash adjuster.

Figure 6:
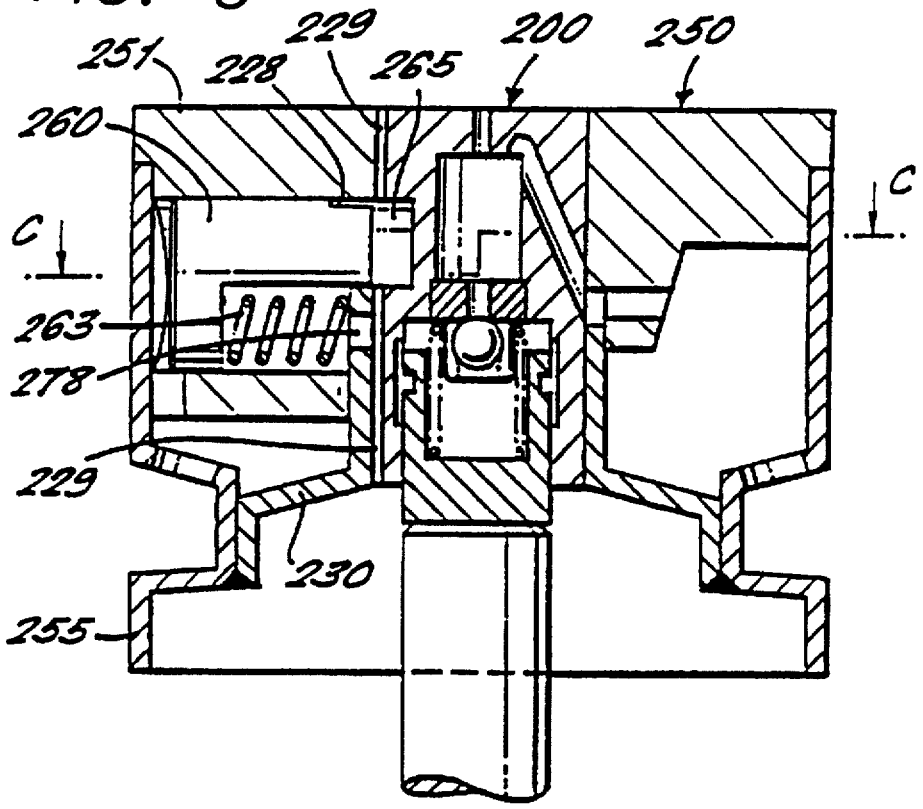
FIG. 6 shows a cross-section of a second embodiment of valve control means according to the present invention, the cross-section being taken along the lines DD of FIG. 7, in the direction of the arrows shown.
Figure 7:
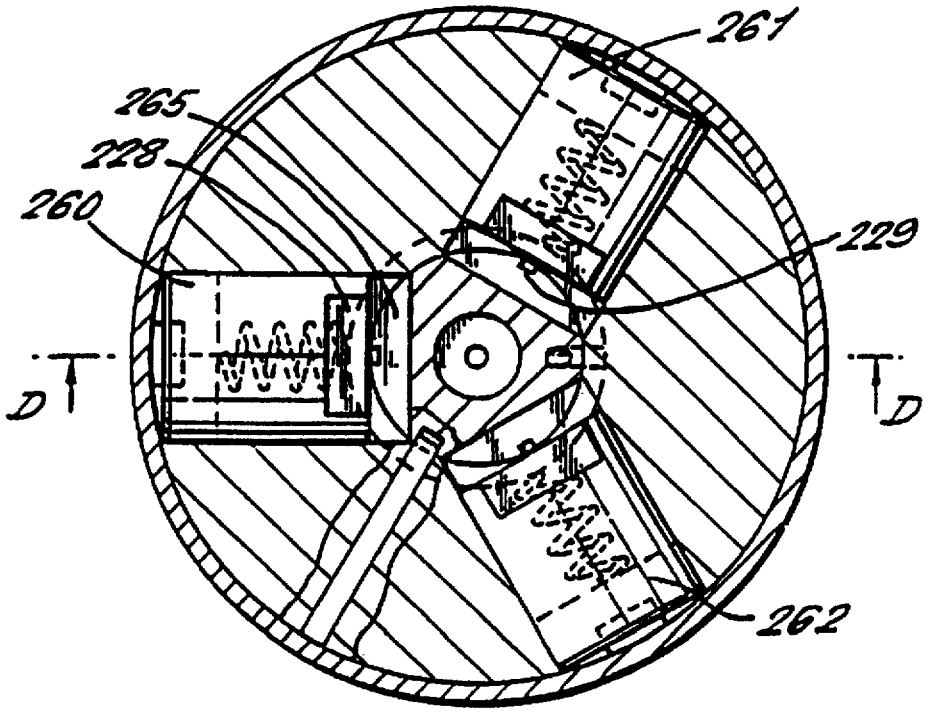
FIG. 7 shows a cross-section of the second embodiment shown in FIG. 6, the cross-section being taken along the lines CC of the FIG. 6, in the direction of the arrows shown.

Turning now to FIGS. 6 and 7 a second preferred embodiment of the invention can be seen. The second preferred embodiment is in most respects identical to the first preferred embodiment and like components have been given similar reference numerals with the prefix 200 being used instead of the prefix 100.

We will only discuss the difference between the second preferred embodiment and the first preferred embodiment.

In a second preferred embodiment, the second cam follower member 250 has a slightly different shape, but remains generally cylindrical. An inner steel skirt 230 is provided in the second embodiment, which is attached to the body 251 of the cam follower member 250 and which is also attached at its lower end to the outer steel skirt 255.

The locking pins 260, 261 and 262 are of an L-shape in cross-section. Springs 263 are provided to act between the lower portion of the locking pins and the inner steel skirt 230. Apertures such as 278 are provided in the inner steel skirt to prevent hydraulic locks by allowing the cavities defined around the springs 263 to be vented to ak groove 229 running axially along the exterior of the cam follower member 200. The locking pin 260 can be seen to have a groove 228 on the top surface thereof. The groove 228 allows fluid to flow from the recess 265 provided on the exterior of the cam follower member 200 to the groove 229 which allows the fluid to flow to the top surface of the cam follower members.

Figure 8:
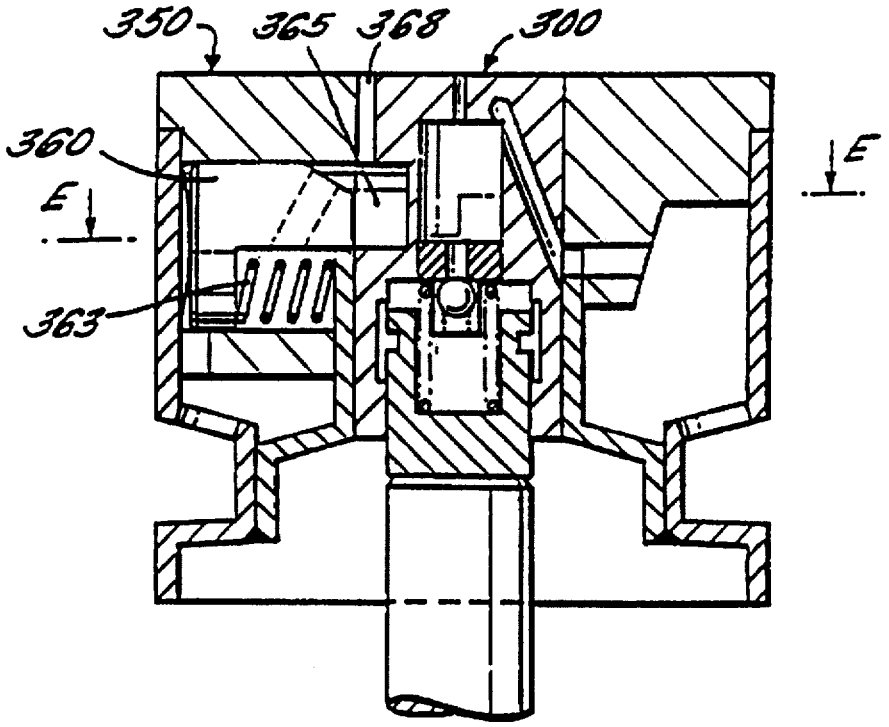
FIG. 8 shows a cross-section of a third embodiment of valve control means according to the invention, taken along the line FF shown in FIG. 9, in the direction of the arrows shown.
Figure 9:
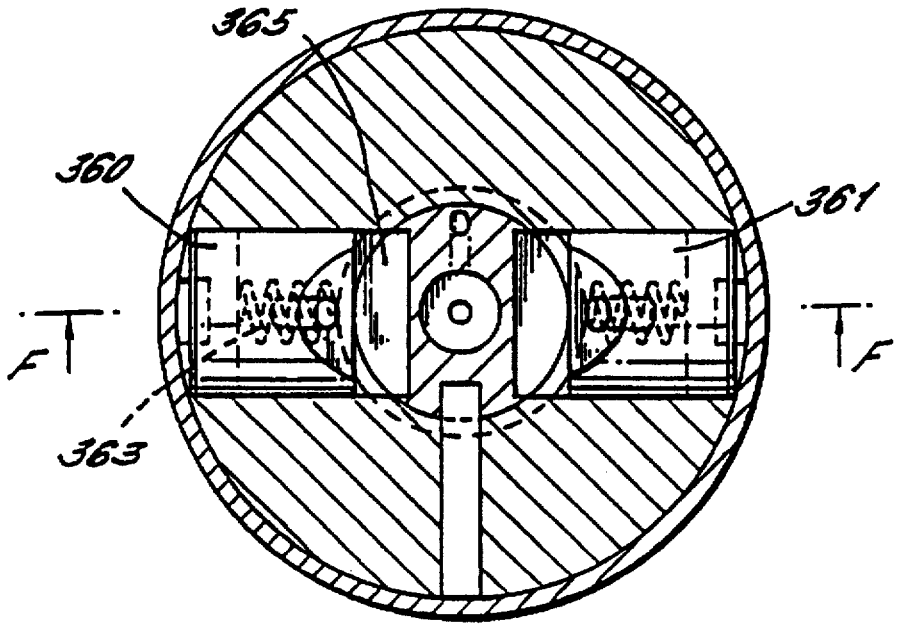
FIG. 9 shows a cross-section of the third embodiment shown in FIG. 8 taken along the line EE shown in FIG. 8, in the direction of the arrows shown.

In FIGS. 8 and 9 and third preferred embodiment of the invention can be seen. The third preferred embodiment is very similar to the second preferred embodiment already described and only differences will be discussed.

The first important difference between the second and third embodiments is that the third embodiment uses only two locking pins 360 and 361. The locking pins 360 and 361 are again of an L-shaped cross-section.

The venting of the cavities surrounding the biasing springs 363 is provided for in a different manner in the third embodiment. The locking pins 360 and 361 each have a tapered portion at the front end thereof and a passage running through the locking pins which allows the cavities surrounding the springs 370 to communicate with the recesses 327 defined on the exterior of the cam follower member 300. The tapered portions of the locking pins 360 and 361 also allow fluid to flow from the recesses 365 through grooves such as grooves 368 defined on the exterior of the cam follower member 300. The grooves relay the oil to the top surfaces of the cam follower members 300 and 350.

It should be appreciated that in all of the above-noted embodiments, the valve control means are designed to be free to rotate within a bore in a cylinder head, thereby reducing wear by allowing the cams to act on different portions of the surfaces of the cam follower members.

It will be appreciate that the three preferred embodiments of the invention share the common inventive feature that the inner cam follower member comprises a hydraulic lash adjuster which engages a cam without the need for a bucket tappet. Thus, the inner cam follower means can be reduced in diameter from those of the prior art, with a corresponding reduction in the overall diameter of the valve control means. This is very important to meet packaging constraints within an engine.

Instead of providing two cams of different profiles, the low lift cam can be replaced by a lobe of circular cross-section such that at low engine speeds the valve can be deactivated (the circular lobe imparting no lift).

The applicant envisages that the locking pin arrangement when interlocking the inner and outer cam follower members will allow some downward movement of the outer cam follower member from its position in engagement with the base circles of the two cams engaged thereby to a position in which it starts to move the inner cam follower member downwardly. This can be achieved by suitable sizing of the recess in the exterior of the inner member. This feature allows for misalignment created by wear and ensures that the force of the valve spring is transmitted to the base circle portion of the low lift cam (or no lift lobe) at low and high engine speeds. The hydraulic lash adjuster thus adjusts for wear of the most worn component (the lowlift cam or no lift lobe) in all conditions. This arrangement ensures that the valve is returned to its valve seat securely at low and high engine speeds, despite differences in wear between the cams of the camshaft (or the no lift lobe and the cam of the camshaft).

I claim:

1. Valve control means for use in an overhead camshaft internal combustion engine which has a poppet valve moveable to open and close a port in a cylinder of the engine, cam means comprising a rotatable camshaft having a first cam portion and a second cam portion having a different cross-section from the first cam portion, the valve control means comprising:

first follower means engageable with the poppet valve and engageable with the first cam portion, which first follower means comprises a hydraulic lash adjuster means which has a first member which defines a closed bore, a second member moveable in the bore of the first member and defining with the first member a variable volume chamber for hydraulic fluid, conduit means for allowing flow of fluid to the chamber and check valve means for controlling the flow of fluid to the chamber, second follower means moveable relative to the first follow means and engageable with the second cam portion; and linking means to enable the first and second follower means to be linked together, wherein when the first and second follower means are not linked the motion of the popper valve is controlled by the first follower means and the popper valve is given in each engine cycle the lift of the first cam portion, when the first and second cam follower means are linked the motion of the popper valve is controlled by the second follower means and the poppet valve is given in each engine cycle the lift of the second cam portion, the second follower means defines a bore and the first follower means is located in the bore with at least a portion of the first member of the hydraulic lash adjuster means being slidable in the bore, the cross-section of the bore matches in shape and size the cross-section of the portion of the first member of the hydraulic lash adjuster means slidable in the bore, the second member of the hydraulic lash adjuster means directly abuts the poppet valve, and engagement means is provided on the exterior surface of the first member of the hydraulic lash adjuster means, the engagement means enabling the linking means to link together the first and second follower means.

2. Valve means as claimed in 1 wherein the first and second follower means are cylindrical and the first follower means has a diameter in the range of 8 to 18 mm.

3. Valve control means as claimed in claim 1 wherein a wear surface is provided on an exterior surface of the first member of the hydraulic lash adjuster means and the wear surface is directly abutted by the first cam portion.

4. Valve control means as claimed in claim 1 wherein the bore is of circular cross-section and the first member of the hydraulic lash adjuster means is of a circular exterior cross-section, the diameter of the bore corresponding to the exterior diameter of the first member of the hydraulic lash adjuster means.

5. Valve control means as claimed in claim 1, wherein the engagement means comprises a recess in the exterior surface of the first member of the hydraulic lash adjuster means and the linking means comprises a locking pin in the second follower means which is extendable from the second follower means to engage the recess.

6. Valve control means for use in an overhead camshaft internal combustion engine which has a poppet valve moveable to open and close a port in a cylinder of the engine, cam means comprising a rotatable camshaft having a cam portion and a lobe portion of circular cross-section, the valve control means comprising:

first follower means engageable with the poppet valve and engageable with the portion of circular cross-section, which first follower means comprises an hydraulic lash adjuster means which has a first member which defines a closed bore, a second member moveable in the bore of the first member and defining with the first member a variable volume chamber for hydraulic fluid, conduit means for allowing flow of fluid to the chamber and check valve means for controlling the flow of fluid to the chamber, second follower means moveable relative to the first follower means and engageable with the cam portion, and linking means to enable the first and second follower means to be linked together, wherein when the first and second follower means are not linked the motion of the poppet valve is controlled by the first follower means which engages the portion of circular cross-section and thereby imparts no lift to the popper valve, when the first and second cam follower means are linked the motion of the poppet valve means is controlled by the second follower means and the poppet valve means is given in each engine cycle means the lift of the cam portion, and wherein the second follower means defines a bore and the first follower means is located in the bore with at least a portion of the first member of the hydraulic lash adjuster means being slidable in the bore, the cross-section of the bore matches in shape and size the cross-section of the portion of the first member of the hydraulic lash adjuster means slidable in the bore, the second member of the hydraulic lash adjuster means directly abuts the poppet valve, and engagement means is provided on the exterior surface of the first member of the hydraulic lash adjuster means, the engagement means enabling the linking means to link together the first and second follower means.

7. Valve control means as claimed in claim 6 wherein the first and second follower means are cylindrical and the first follower means has a diameter in the range of 8 to 18 mm.

8. Valve control means as claimed in claim 6 wherein a wear surface is provided on an exterior surface of the first member of the hydraulic lash adjuster means and the wear surface is directly abutted by the lobe portion of circular cross-section.

9. Valve control means as claimed in claim 6 wherein the engagement means comprises a recess in the exterior surface of the first member of the hydraulic lash adjuster means and the linking means comprises a locking pin in the second follower means which is extendable from the second follower means to engage the recess.

10. Valve control means as claimed in claim 6 wherein the bore is of circular cross-section and the first member of the hydraulic lash adjuster means is of a circular exterior cross-section, the diameter of the bore corresponding to the exterior diameter of the hydraulic lash adjuster means.

* * * * *